United States Patent [19]

Crossley et al.

[11] Patent Number: 4,551,617

[45] Date of Patent: Nov. 5, 1985

[54] HEATING APPARATUS

[75] Inventors: Peter W. Crossley, Havant; Robert D. Smith, Cheshunt, both of England

[73] Assignee: Thorn EMI Domestic Appliances Limited, London, England

[21] Appl. No.: 621,209

[22] Filed: Jun. 15, 1984

[30] Foreign Application Priority Data

Jun. 15, 1983 [GB] United Kingdom ..... 8316306

[51] Int. Cl.[4] ..... H05B 3/68

[52] U.S. Cl. ..... 219/464; 219/343; 219/354; 219/462; 219/466; 219/540; 219/553; 313/274; 313/315

[58] Field of Search ..... 219/343, 348, 349, 350, 219/351, 352, 353, 354, 388, 405, 411, 458, 459, 460, 461, 462, 463, 464, 466, 467, 525, 530, 531, 540, 553; 34/4; 165/105; 99/425; 313/315, 331, 274, 332, 381; 236/17

[56] References Cited

U.S. PATENT DOCUMENTS

| | | | |
|---|---|---|---|
| 2,601,011 | 6/1952 | Wilcox | 219/461 |
| 2,844,699 | 7/1958 | Miskella | 219/531 X |
| 2,859,368 | 11/1958 | Biggs et al. | 219/553 X |
| 2,954,826 | 10/1960 | Sievers | 219/553 X |
| 2,988,634 | 6/1961 | Miskella | 219/553 X |
| 3,179,789 | 4/1965 | Gialanella | 219/349 |
| 3,244,859 | 4/1966 | Whiteford | 219/348 |
| 3,304,406 | 2/1967 | King | 219/411 |
| 3,355,574 | 11/1967 | Bassett, Jr. | 219/464 |
| 3,360,765 | 12/1967 | Strange et al. | 219/354 X |
| 3,363,090 | 1/1968 | Langley | 219/540 |
| 3,407,285 | 10/1968 | Jacobs | 219/156 |
| 3,579,021 | 5/1971 | Kimball | 313/274 |
| 3,675,070 | 7/1972 | Prytkiv | 313/315 X |
| 3,714,885 | 2/1973 | Wertheimer et al. | 219/354 X |
| 3,723,792 | 3/1973 | Chiola et al. | 313/315 X |
| 3,864,598 | 2/1975 | Cardwell, Jr. | 313/315 X |
| 3,967,385 | 7/1976 | Culbertson | 34/4 |
| 4,069,437 | 1/1978 | Notelteirs et al. | 313/315 |
| 4,221,672 | 9/1980 | McWilliams | 219/464 X |
| 4,406,944 | 9/1983 | Crain et al. | 219/351 X |
| 4,426,573 | 1/1984 | Fudickas et al. | 219/530 X |

FOREIGN PATENT DOCUMENTS

| | | | |
|---|---|---|---|
| 2809131 | 9/1979 | Fed. Rep. of Germany | 219/464 |

*Primary Examiner*—Volodymyr Y. Mayewsky

*Attorney, Agent, or Firm*—Fleit, Jacobson, Cohn & Price

[57] ABSTRACT

Heating apparatus includes a tray having a layer of insulative material disposed therewithin, above which a number of infra-red lamps are supported. The ends of each lamp are provided with a pinch seal having an amp tag connector, which is connected to the respective end of a filament within the lamp, sealed therein. Each pinch seal is enclosed within a ceramic housing and the heating apparatus is mounted beneath a layer of glass ceramic.

A plate of heat-conductive material is intimately disposed between the top surface of one or more of the ceramic housings and the under surface of the glass ceramic, so as to encourage heat from the pinch seals to conduct in an upward direction towards the glass ceramic.

7 Claims, 2 Drawing Figures

HEATING APPARATUS

This invention relates to heating apparatus and in particular, though not exclusively, to such apparatus including one or more sources of infra-red radiation.

Heating apparatus of this type is described and claimed in our copending British Application No. 8320717, wherein four quartz-halogen infra-red lamps are supported above a shallow metallic tray containing a layer of insulative material, a layer of glass ceramic material being disposed above the lamps as a hot plate for the heating apparatus, thereby forming a cooking hob.

The infra-red lamp is described in more detail and claimed in copending European Application No. 84301636.1, in the name of THORN EMI plc, wherein the lamp comprises a filament supported within a glass tube, each end of the lamp having a pinch seal with an electrical lead connected to a piece of metal foil which is in turn connected to the filament sealed into the respective end thereof, the lead being welded to an appropriate electrical connector. The pinch seal is enclosed within a ceramic housing, which is shaped to provide location of the lamp in the correct position on flanges provided either side of the metallic tray, when the lamp is incorporated within the above-mentioned heating apparatus.

However, it is necessary to maintain the pinch seals of the infra-red lamp at a relatively low temperature, in order to prolong the life of the lamp and, although the ceramic housing has been found to conduct heat to a limited extent from the pinch seal to the supporting flange of the metallic tray, this may not be sufficient on its own to achieve longevity of the lamp under all operation conditions.

The object of the present invention is therefore to alleviate substantially the problem of maintaining a relatively low temperature of the pinch seals.

According to the present invention there is provided heating apparatus for mounting beneath a hot plate, said apparatus including at least one infra-red lamp, the or each lamp comprising a filament supporting within a generally tubular envelope and having, at each end thereof, a pinch seal with an electrical connection to the respective end of the filament sealed therein, said apparatus further including means for conducting heat from said pinch seal in a substantially upward direction towards said hot plate.

Preferably, the pinch seal at each end of the or each lamp is substantially enclosed within a ceramic housing.

It is also preferable that the means for conducting heat includes a plate of heat-conductive material intimately disposed between the top surface of the ceramic housing and the under surface of the hot plate.

A layer of a heat sink compound may also be intimately disposed between the plate of heat conductive material and the under surface of the hot plate, and/or between the plate and the upper surface of the ceramic housing.

Figure 1:
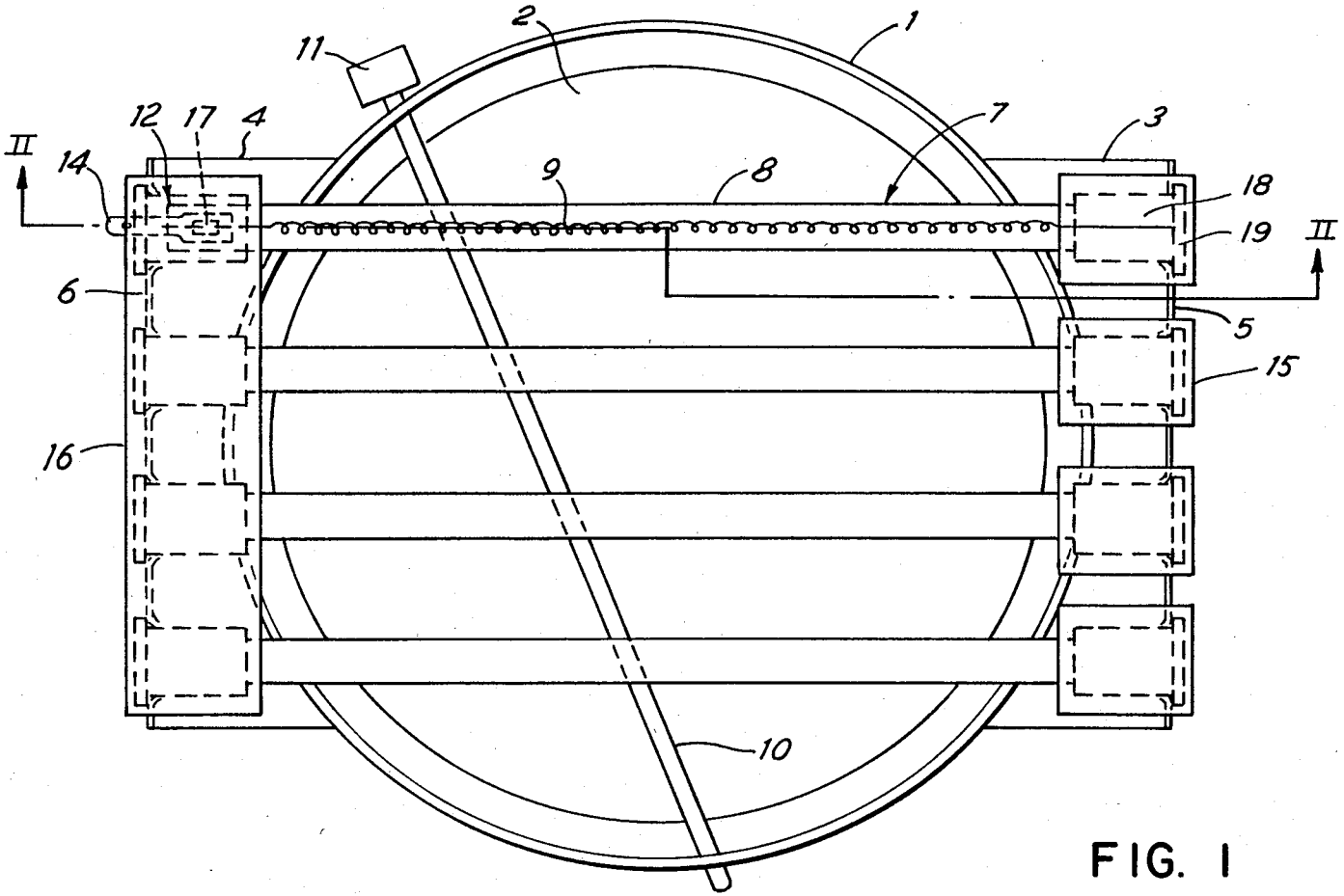
Figure 2:
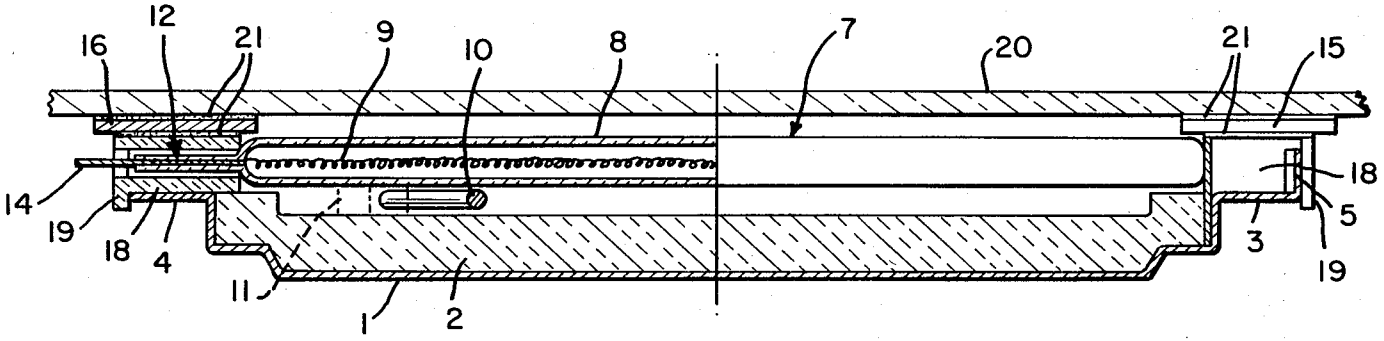

The invention will now be further described by way of example only with reference to the accompanying drawing, wherein:

FIG. 1 shows a plan view of heating apparatus, in accordance with the present invention, illustrating two embodiments thereof, and FIG. 2 shows schematically a sectional view of the apparatus mounted beneath a glass ceramic layer of a cooking hob.

Referring to the Figures, heating apparatus includes a generally circular shallow tray 1, preferably made of metal, which has disposed therewithin a layer 2 of insulative material, preferably a material known as Microtherm. The tray 1 has two extending flanges, 3 and 4, arranged on opposite sides of the rim of the tray 1, each flange having upturned end portions, 5 and 6, respectively.

A number of infra-red lamps, one being shown at 7, are disposed above the layer 2 of insulative material and are supported at each end by the flanges, 3 and 4.

Each infra-red lamp 7 is preferably a quartz-halogenated lamp comprising a tubular quartz envelope 8, within which a tungsten filament 9 is supported. Both ends of each lamp are enclosed within respective ceramic end caps, one being shown at 18, having a location tab 19. The lamps can therefore easily be inserted in apertures provided in the upturned portions, 5 and 6, on the flanges, 3 and 4.

The ceramic end cap, at each end of the lamps, encloses a pinch seal, one being shown generally at 12, having an amp tag connector, one shown at 14, or any other suitable form of male tab connector, which is connected via metal foil 17 to the respective end of the filament 9, sealed therein. Electrical leads (not shown) can then be connected to each amp tag connector, so as to supply power to each infra-red lamp.

The heating apparatus also preferably includes a thermal limiter 10, disposed between the lamps and the layer 2 of insulative material. The thermal limiter 10 is arranged to operate a microswitch 11, so as to disconnect the power to the lamps when the temperature sensed by the thermal limiter 10 reaches a threshold value.

The heating apparatus and infra-red lamp, so far described, are described in greater detail, and claimed, in the two above-mentioned copending British Application No. 8320717 and European Application No. 84301636.1.

To prolong the life of the infra-red lamps it is necessary to maintain the pinch seals at a relatively low temperature, this being achieved to a certain extent by the ceramic end caps, which conduct a limited amount of heat from the pinch seals to the respective flanges, 3 and 4.

However, to improve substantially the heat conduction away from the pinch seals the present invention provides, in a first embodiment shown on the flange 3, a respective plate of heat-conductive material, preferably aluminium, disposed above each of the ceramic end caps, one such plate being shown at 15.

As disclosed in the aforementioned British Application No. 8320717, a layer of glass ceramic 20 is disposed above the heating apparatus to provide a glass ceramic cooking hob and, in the present invention, the aluminium plates are intimately disposed between the top surface of the ceramic end caps and the under surface of the glass ceramic layer, thereby encouraging heat from the pinch seals to conduct in an upward direction to the glass ceramic layer.

A heat sink compound 21 may also be provided between, and in contact with, each aluminium plate and the glass ceramic layer, and/or between each plate and the top of each ceramic end cap thereby further improving the upwardly directed heat-conductive path. The heat sink compound has an added advantage of being relatively flexible, so as to allow a certain amount of movement, caused by expansion and contraction of the metallic tray, flanges and/or the aluminium plates.

An alternative embodiment of the present invention is shown on the flange 4, wherein each plate, such as 15, provided separately for covering each end cap is replaced by a single aluminium plate 16, which extends over all of the end caps supported on the flange 4. The plate 16 may then be covered with the heat sink compound, above which the glass ceramic layer is placed.

The plates, 15 or 16, may of course be fabricated from any suitable heat-conductive material.

Although a single coil tungsten filament is shown in the Figure, it may be preferable to employ a coiled coil filament, which generally possesses substantially greater resilience to mechanical shock than single coil filaments.

It can therefore be envisaged that the present invention provides a heat conductive path extending upwards from the ceramic housing, enclosing each pinch seal of the infra-red lamp, towards the glass ceramic layer, thereby forming an efficient heat sink for each pinch seal, so as to reduce the temperature thereof and consequently to prolong the life of the lamp.

We claim:

1. Heating apparatus mounted beneath a glass ceramic layer of a cooking hob, said apparatus including an infra-red lamp and thermally-insulative material below said lamp, and support means supporting said lamp and said thermally-insulative material in a desired location relative to each other and to said glass ceramic layer, said lamp comprising a generally tubular envelope formed from an electrically-insulative and thermally-conductive material, a filament supported within said envelope, first and second pinch seals formed integrally with said envelope and closing respective ends of said envelope, electrical connections to respective ends of said filament sealed within said pinch seals, and first and second thermally-conductive ceramic housings substantially enclosing respectively said first and second pinch seals, said apparatus being adapted to constrain thermal radiation generated by said lamp to a predetermined region of said glass ceramic layer, said apparatus further including first and second thermally-conductive members located respectively in thermal contact with said ceramic housings and an undersurface of said glass ceramic layer so as to conduct heat, from said pinch seals in a substantially upward direction towards a region of said glass ceramic layer outside of said predetermined region.

2. Heating apparatus as claimed in claim 1 wherein said thermally-conductive members each comprises a plate of thermally-conductive material located in thermal contact with an upper outer surface of said respective ceramic housing.

3. Heating apparatus as claimed in claim 1 wherein more than one lamp is provided, said lamps being arranged is a substantially parallel arrangement above said material, said thermally-conductive members each comprising a plate of thermally-conductive material located in thermal contact with respective upper surfaces of at least two adjacently-positioned ceramic housings of said lamps.

4. Heating apparatus at claimed in claim 1 wherein a layer of heat sink compound is intimately disposed between an outer surface of said ceramic housings and a facing surface of said respective thermally-conductive member.

5. A cooking hob comprising a layer of glass ceramic material and a heating apparatus supported beneath said layer, said apparatus including an infra-red lamp and thermally-insulative material below said lamp, and support means supporting said lamp and said thermally-insulative material in a desired location relative to each other and to said glass ceramic layer, said lamp comprising a generally tubular envelope formed from an electrically-insulative and thermally-conductive material, a filament supported within said envelope, first and second pinch seals formed integrally with said envelope and closing respective ends of said envelope, electrical connections to respective ends of said filament sealed within said pinch seals, said apparatus being adapted to constrain thermal radiation generated by said lamp to a predetermined region of said glass ceramic layer, and first and second thermally-conductive ceramic housings substantially enclosing respectively said first and second pinch seals, said apparatus further including first and second thermally-conductive members located respectively in thermal contact with an upper outer surface of said ceramic housings and an undersurface of said glass ceramic layer, so as to conduct heat, in use, from said pinch seals in a substantially upward direction towards a region of said glass ceramic layer outside of said predetermined region.

6. A cooking hob as claimed in claim 5 wherein said thermally-conductive members each comprises a plate of thermally-conductive material.

7. A cooking hob as claimed in claim 5 wherein a heat sink compound is intimately disposed between an upper surface of said thermally-conductive member and said underside of said glass ceramic layer.

* * * * *